US011850763B2

(12) United States Patent
Paauw et al.

(10) Patent No.: US 11,850,763 B2
(45) Date of Patent: Dec. 26, 2023

(54) HAIR CUTTING UNIT HAVING A COUPLING STRUCTURE

(71) Applicant: KONINKLIJKE PHILIPS N.V., Eindhoven (NL)

(72) Inventors: Hendrik Klaas Paauw, Roden (NL); Hilde Seip, Groningen (NL)

(73) Assignee: KONINKLIJKE PHILIPS N. V., Eindhoven (NL)

( * ) Notice: Subject to any disclaimer, the term of this patent is extended or adjusted under 35 U.S.C. 154(b) by 250 days.

(21) Appl. No.: 15/733,102

(22) PCT Filed: Nov. 4, 2018

(86) PCT No.: PCT/EP2018/080074
§ 371 (c)(1),
(2) Date: May 18, 2020

(87) PCT Pub. No.: WO2019/101496
PCT Pub. Date: May 31, 2019

(65) Prior Publication Data

US 2020/0361104 A1 Nov. 19, 2020

(30) Foreign Application Priority Data

Nov. 21, 2017 (EP) ..... 17202788

(51) Int. Cl.
*B26B 19/38* (2006.01)
*B26B 19/14* (2006.01)

(52) U.S. Cl.
CPC ..... *B26B 19/386* (2013.01); *B26B 19/145* (2013.01)

(58) Field of Classification Search
CPC ..... B26B 19/14; B26B 19/141; B26B 19/143; B26B 19/145; B26B 19/386
(Continued)

(56) References Cited

U.S. PATENT DOCUMENTS 2,337,391 A 12/1943 Horowitz
2,565,828 A 8/1951 Leonardus
(Continued)

FOREIGN PATENT DOCUMENTS

CN 101879722 A * 11/2010
CN 106078815 A * 11/2016
(Continued)

OTHER PUBLICATIONS

International Search Report and Written Opinion dated May 20, 2019 for International Application No. PCT/EP2018/080074 Filed Nov. 4, 2018.

*Primary Examiner* — Laura M Lee

(57) ABSTRACT

A hair cutter of a shaving device has a support with a skin contacting surface, and a retainer releasably couplable to the support by a coupler to retain an external cutter in an operational/assembled condition of the hair cutter. A retained element of the external cutter is retained between a first retaining member of the retainer and a second retaining member of the support where, in response to manually turning the retainer relative to the support, the shaving surface protrudes relative to the skin contacting surface in the axial direction over an exposure distance. The coupler has a first guide on the support and a second guide on the retainer. The first and second guides mutually engage resulting from manually turning the retainer relative to the support when the retainer is in any angular position between first and second angular positions about the axis of rotation relative to the support.

19 Claims, 5 Drawing Sheets

(58) Field of Classification Search
USPC ..... 30/43.6, 346.51
See application file for complete search history.

(56) References Cited

U.S. PATENT DOCUMENTS

| | | | | |
|---|---|---|---|---|
| 3,233,323 | A | 2/1966 | Josef | |
| 4,318,223 | A | 3/1982 | Bergsma | |
| 4,711,028 | A | 12/1987 | Bergsma | |
| 4,896,421 | A * | 1/1990 | Geertsma | B26B 19/145 30/346.51 |
| 9,827,684 | B2 * | 11/2017 | Van Toor | B26B 19/145 |
| 2016/0052153 | A1 * | 2/2016 | Oosterhoff | B26B 19/146 30/43.6 |
| 2017/0120465 | A1 * | 5/2017 | Shimizu | B26B 19/143 |

FOREIGN PATENT DOCUMENTS

| | | |
|---|---|---|
| EP | 0231966 | 8/1987 |
| JP | H09122362 A | 5/1997 |
| WO | 2014/020500 | 2/2014 |
| WO | 2015/169625 | 11/2015 |

* cited by examiner

HAIR CUTTING UNIT HAVING A COUPLING STRUCTURE

CROSS REFERENCE TO RELATED APPLICATIONS

This application is the U.S. National Phase application under 35 U.S.C. § 371 of International Application No. PCT/EP2018/080074 filed Nov. 4, 2018, published as WO 2019/101496 on May 31, 2019, which claims the benefit of European Patent Application Number 17202788.0 filed Nov. 21, 2017. These applications are hereby incorporated by reference herein.

FIELD OF THE INVENTION

The invention relates to a hair cutting unit for use in a shaving device, said hair cutting unit comprising an external cutting member having a shaving surface with hair-entry openings, an internal cutting member which is rotatable relative to the external cutting member about an axis of rotation and which has a plurality of hair-cutting elements, a supporting member having a skin contacting surface surrounding the external cutting member, and a retaining component which is releasably couplable to the supporting member by means of a coupling structure and which is configured to retain the external cutting member in an operational position relative to the supporting member in an assembled condition of the hair cutting unit, wherein, in the assembled condition, a retained element of the external cutting member is retained between a first retaining member of the retaining component and a second retaining member of the supporting member at least in an axial direction parallel to the axis of rotation, wherein, in the assembled condition and in a parallel orientation of the shaving surface relative to the skin contacting surface, the shaving surface protrudes relative to the skin contacting surface in the axial direction over an exposure distance, and wherein the coupling structure comprises a first guiding member provided on the supporting member and a second guiding member provided on the retaining component, the first and second guiding members being configured to mutually engage when the retaining component is in any angular position between a first angular position and a second angular position about the axis of rotation relative to the supporting member, the first and second angular positions being mutually different, and to establish the assembled condition in the second angular position of the retaining component.

The invention further relates to a shaving unit comprising at least two hair cutting units of the type mentioned in the opening paragraph and a supporting component supporting the at least two hair cutting units.

The invention further relates to a shaving head comprising a base structure including a coupling member configured to releasably couple the shaving head to a main body of a shaving device, and a shaving unit of the type mentioned here before which is releasably couplable to the base structure.

The invention further relates to a shaving device comprising a main body accommodating an actuator, and a shaving head of the type mentioned here before which is releasably couplable to the main body for being driven by the actuator.

BACKGROUND OF THE INVENTION

A hair cutting unit, a shaving unit, a shaving head and a shaving device of the types mentioned in the opening paragraphs are known from WO 2015/169625 A1. The known shaving unit has three hair cutting units. The supporting member of each hair cutting unit is pivotally supported by the supporting component of the shaving unit. The retaining component of each hair cutting unit has a mainly annular base portion. The second guiding member of each hair cutting unit comprises two fulcrum pins arranged on two diametrically opposite circumferential portions of the base portion of the retaining component. The supporting member of each hair cutting unit has a mainly cylindrical receiving member for accommodating the external cutting member of the hair cutting unit. The first guiding member of each hair cutting unit comprises two recesses provided in diametrically opposite positions on an inner wall of the cylindrical receiving member of the supporting member. In the assembled condition of the known shaving unit, the two fulcrum pins of each retaining component are each received in a respective one of these two recesses, so that the retaining component is pivotally coupled to the supporting member. The second retaining member of each hair cutting unit comprises two small supporting surfaces provided in two diametrically opposite positions on an inner rim provided on the inner wall of the cylindrical receiving member, each supporting surface being adjacent to a respective one of the two recesses on the inner wall. In the assembled condition, a circumferential flange of the external cutting member, forming the retained element of the external cutting member, is retained between these two supporting surfaces and an annular abutment surface, forming the first retaining member of the hair cutting unit and provided on a side of the annular base portion of the retaining component facing said flange. Thereby the external cutting member is pivotal relative to the supporting member in conjunction with the retaining component, wherein a pivot axis of the external cutting member is defined by the positions of the two small supporting surfaces on the inner wall of the cylindrical receiving member. A user can disassemble this known shaving unit by manually turning each retaining component in a predefined direction about the axis of rotation of the associated internal cutting member, whereby the two fulcrum pins are released from the recesses. As a next step the user can successively remove the retaining components and the internal and external cutting members from the supporting members, for example to clean them. After cleaning the user can replace the external and internal cutting members in the supporting members and retain them in their operational positions relative to the supporting members by coupling of the retaining components to the supporting members, i.e. by inserting the fulcrum pins in the recesses by manually turning the retaining components about the axes of rotation of the internal cutting members from the first angular position into the second angular position relative to the supporting members.

A disadvantage of the known shaving unit and the known hair cutting units is that, to be able to assemble the shaving unit in the manner as described here before, in particular to be able to couple the retaining components to the supporting members, the external cutting members must be in their operational positions relative to the supporting members, wherein the shaving surfaces of the external cutting members protrude relative to the skin contacting surfaces of the supporting members over the exposure distance which is present during normal operation of the shaving unit. To achieve these protruding positions of the external cutting members during assembly of the shaving unit, the user has to hold the supporting component of the shaving unit in an upside-down position by one hand with the supporting members being free from contact with any ambient items. Simultaneously the user has to couple the retaining components one by one to the supporting members by the other hand. This is not convenient for the user. It is for example not possible to assemble the known shaving unit starting from a condition wherein the supporting members of the hair cutting units lie upside-down on a flat surface like a table top surface, because in such a condition the external cutting members will not protrude relative to the supporting members, as a result of which the fulcrum pins provided on the retaining components cannot engage the recesses provided on the supporting members in the first angular position of the retaining components.

U.S. Pat. No. 2,565,828 discloses a cutting head of a dry-shaving apparatus. The cutting head comprises a cutting plate, provided with radial slits, and a rotatable cutting member. The cutting plate is secured to the casing of the apparatus by means of a nut. A flange of the cutting plate is retained between a flange of the casing and a flange of the nut.

SUMMARY OF THE INVENTION

An object of the present invention is to provide a hair cutting unit and a shaving unit of the types mentioned in the opening paragraphs which do not have the disadvantage of the known hair cutting unit and the known shaving unit. In particular an object of the present invention is to provide a hair cutting unit and a shaving unit of the types mentioned in the opening paragraphs which can be assembled by the user starting from a condition wherein the supporting member of the hair cutting unit lies in an upside-down position on a flat surface.

In order to achieve said object, according to the invention a hair cutting unit of the type mentioned in the opening paragraphs is characterized in that the first and second guiding members are configured such that, when the first and second guiding members mutually engage in the first angular position of the retaining component, the retained element of the external cutting member is moveable between the first and second retaining members parallel to the axis of rotation over a distance which is at least equal to the exposure distance.

In order to achieve said object, according to the invention a shaving unit of the type mentioned in the opening paragraphs is characterized in that each hair cutting unit used therein is a hair cutting unit according to the invention.

To assemble the hair cutting unit according to the invention, like with the known hair cutting unit, the user first has to place the external cutting member and the internal cutting member in the supporting member. Subsequently, like with the known hair cutting unit, the user has to couple the retaining component to the supporting member by manually turning the retaining component about the axis of rotation of the internal cutting member relative to the supporting member from the first angular position to the second angular position. By turning the retaining component in this way, the first and second guiding members of the coupling structure mutually engage. Like with the known hair cutting unit, the first and second guiding members are configured such that, in the second angular position of the retaining component, the retained element of the external cutting member is retained between the first retaining member of the retaining component and the second retaining member of the supporting member in the axial direction, so that the external cutting member is in its operational position with its shaving surface protruding relative to the skin contacting surface of the supporting member. According to the invention, the first and second guiding members of the coupling structure are configured such that, when the first and second guiding members mutually engage in the first angular position of the retaining component, i.e. in an initial phase of the step of coupling the retaining component to the supporting member, the retained element of the external cutting member is movable between the first and second retaining members parallel to the axis of rotation over a distance which is at least equal to the exposure distance of the shaving surface when the external cutting member is in the operational position. As a result, when during said initial phase of the coupling step the supporting member lies upside-down on a flat surface with, consequently, the external cutting member in a fully recessed position relative to the skin contacting surface of the supporting member, the first and second guiding members will be able to mutually engage when the retaining component is moved into the first angular position. By subsequently turning the retaining component from the first angular position into the second angular position, the first and second guiding members will guide the retaining component relative to the supporting member in the axial direction towards the skin contacting surface of the supporting member, so that the external cutting member is moved by the retaining component relative to the supporting member from its initial recessed position into its operational position. Thus, the hair cutting unit according to the invention and the shaving unit according to the invention comprising such hair cutting units can be assembled by the user starting from a position wherein the supporting members lie upside-down on a flat surface, with the external cutting members recessed therein, without lifting the hair cutting unit and the shaving unit from said flat surface. This is very convenient for the user, because the user can hold the hair cutting unit and the shaving unit in a position in contact with the flat surface during coupling of the retaining components to the supporting members.

Starting from said initial phase of the step of coupling the retaining component to the supporting member, the assembled condition of the hair cutting unit according to the invention is thus achieved by manually turning the retaining component relative to the supporting member about the axis of rotation from the first angular position into the second angular position over an angular distance about the axis of rotation present between the first and second angular positions which is smaller than 360°. Thus, the first and second guiding members are configured such that, when the first and second guiding members mutually engage in the first angular position of the retaining component resulting from manually turning the retaining component relative to the supporting member about the axis of rotation from the second angular position, i.e. the assembled condition, to the first angular position over said angular distance about the axis of rotation present between the first and second angular positions smaller than 360°, the retained element of the external cutting member is moveable between the first and second retaining members parallel to the axis of rotation over said distance which is at least equal to the exposure distance.

In an embodiment of a hair cutting unit according to the invention, the second guiding member comprises a guiding surface which, in the assembled condition, extends obliquely relative to a tangential direction relative to the axis of rotation, and the first guiding member comprises an abutment element for engaging the guiding surface. The guiding surface and the abutment element provide a robust and simple structure of the coupling structure. The abutment element may comprise an additional guiding surface which, in the assembled condition, extends obliquely relative to the tangential direction for co-operation with the guiding surface of the second guiding member. In an alternative embodiment, the first guiding member comprises the guiding surface and the second guiding member may comprise the abutment element. In this alternative embodiment, the abutment element may comprise the additional guiding surface. In a further alternative embodiment, the first and second guiding members each comprise a guiding surface which, in the assembled condition, extends obliquely relative to a tangential direction relative to the axis of rotation, wherein the guiding surfaces of the first and second guiding members are configured to mutually co-operate.

In a further embodiment of a hair cutting unit according to the invention, the guiding surface extends obliquely over an angular distance about the axis of rotation which is at least equal to 15% of an angular distance between the first and second angular positions. As a result a torque, which the user needs to exert on the retaining component about the axis of rotation in order to rotate the retaining component from the first angular position to the second angular position and establish the assembled condition of the hair cutting unit, is limited. Preferably, the guiding surface is plain seen in a tangential cross-section relative to the axis of rotation.

In a preferred embodiment of a hair cutting unit according to the invention, the retaining component has a mainly annular base portion, the supporting member has a mainly cylindrical receiving member for accommodating the external cutting member, the second guiding member comprises two guiding elements provided on two diametrically opposite circumferential portions of the base portion and each comprising a guiding surface which, in the assembled condition, extends obliquely relative to the tangential direction, and the first guiding member comprises two abutment elements provided in diametrically opposite positions on an inner wall of the receiving member for engaging the guiding surface of a respective one of the two guiding elements. This embodiment with two abutment elements and two obliquely extending guiding surfaces provides a robust and simple structure of the coupling structure. Alternatively the second guiding member may comprise more than two obliquely extending guiding surfaces and the first guiding member may comprise more than two abutment elements for engaging the more than two guiding surfaces. For example, the second guiding member may comprise three guiding surfaces provided on three circumferential portions of the base portion which are mutually arranged with 1200 intervals about the axis of rotation, and the first guiding member may comprise three abutment elements provided on the inner wall of the receiving member which are mutually arranged with 120° intervals about the axis of rotation.

In a further embodiment of a hair cutting unit according to the invention, the retained element is a circumferential flange of the external cutting member.

In a yet further embodiment of a hair cutting unit according to the invention, the first retaining member comprises a plurality of abutment surfaces provided on a side of the annular base portion facing the retained element of the external cutting member in the assembled condition, and the second retaining member comprises two supporting elements provided in diametrically opposite positions on the inner wall of the receiving member, each supporting element being positioned adjacent to a respective one of the two abutment elements seen in the axial direction. In this embodiment, in order to provide a stable support of the external cutting member by the retaining component in the assembled condition, the first retaining member preferably has at least three abutment surfaces which are regularly distributed on said side of the annular base portion of the retaining component. Alternatively, said side of the annular base portion may have a single annular abutment surface extending over 360° about the axis of rotation. In this further embodiment, in the assembled condition the retained element of the external cutting member is retained between said two supporting elements provided on the supporting member and said plurality of abutment surfaces provided on the retaining component. Said two supporting elements provide, in conjunction with said plurality of abutment surfaces, a pivot structure by means of which the external cutting member is pivotal together with the retaining member relative to the supporting member. A position of a pivot axis of said pivot structure is defined by the positions of the two supporting elements relative to the supporting member.

In an embodiment of a shaving unit according to the invention, the supporting member of each hair cutting unit is pivotally supported by the supporting component. In this embodiment the hair cutting units of the shaving unit may be individually and independently pivotal relative to the supporting component of the shaving unit, so that the orientations of the hair cutting units can be individually adapted to the local contours of the skin in contact with the hair cutting units.

Furthermore, according to the invention, a shaving head of the type mentioned in the opening paragraphs is characterized in that the shaving unit used therein is a shaving unit according to the invention as described here before.

Furthermore, according to the invention, a shaving device of the type mentioned in the opening paragraphs is characterized in that the shaving head used therein is a shaving head according to the invention as described here before.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
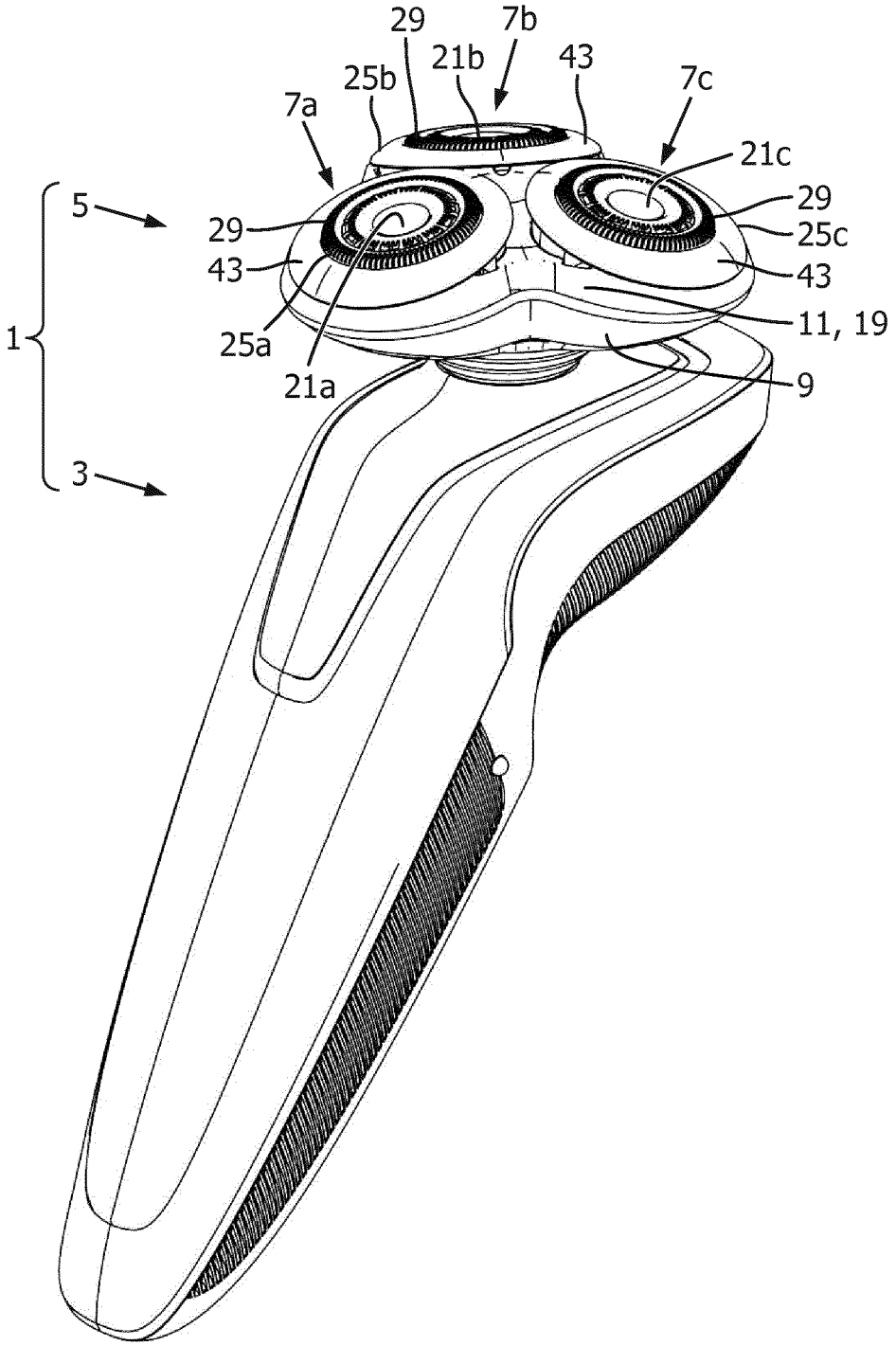
FIG. 1 shows an embodiment of a shaving device according to the invention.

FIG. 1 shows an embodiment of a shaving device 1 according to the invention. The shaving device 1 comprises a main body 3 and a shaving head 5 according to the invention. The main body 3 accommodates an actuator, not visible in FIG. 1, for example an electric motor. The shaving head 5 is releasably couplable to the main body 3 and comprises three hair cutting units 7*a*, 7*b*, 7*c* according to the invention. In a condition shown in FIG. 1, wherein the shaving head 5 is coupled to the main body 3, the hair cutting units 7*a*, 7*b*, 7*c* can be driven by the actuator when the shaving device 1 is activated by a user.

Figure 2:
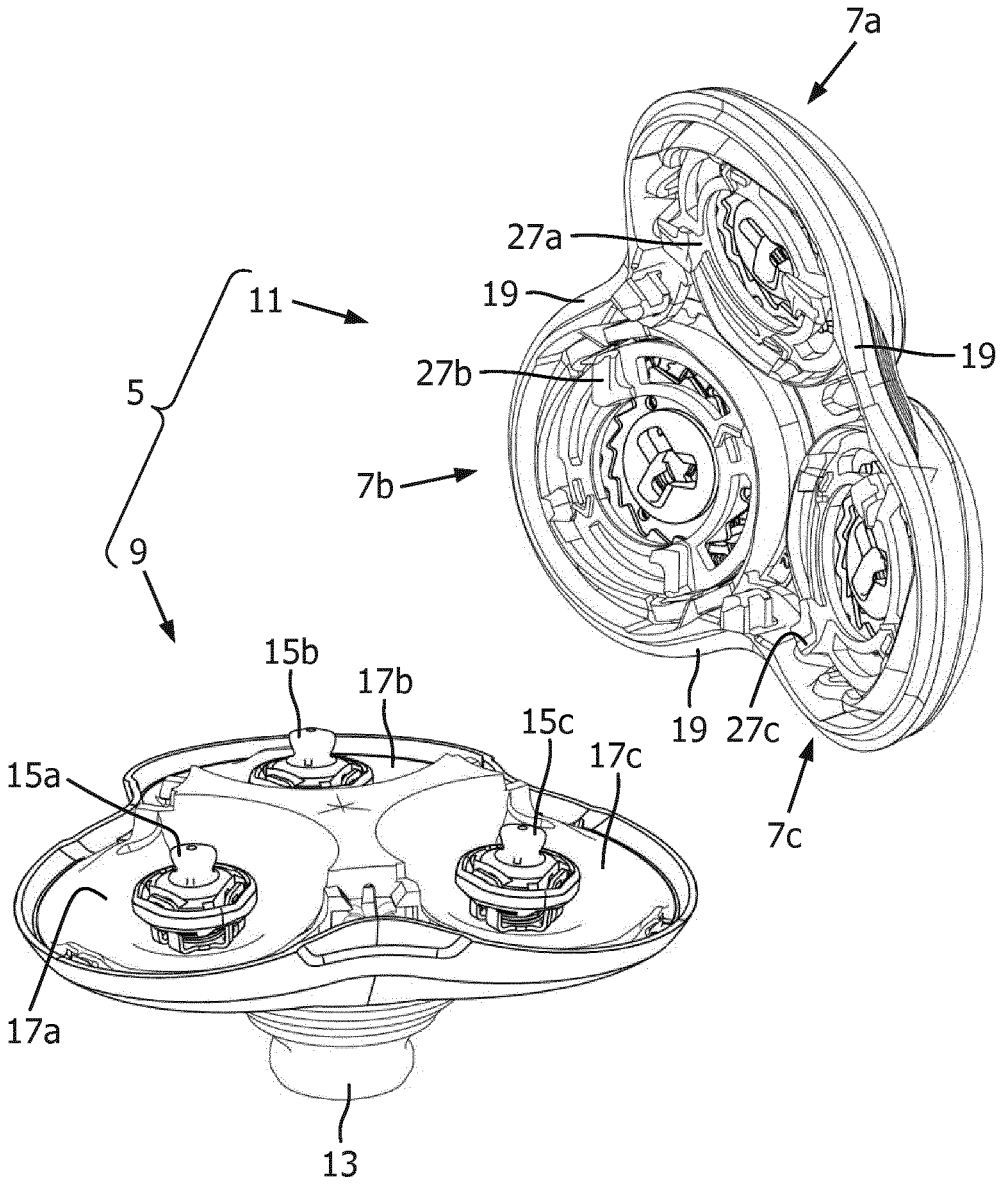
FIG. 2 shows an embodiment of a shaving head according to the invention used in the shaving device of FIG. 1 and comprising a shaving unit according to the invention.

The shaving head 5 is shown in more detail in FIG. 2. The shaving head 5 comprises a base structure 9 and a shaving unit 11 according to the invention. The base structure 9 comprises a coupling member 13 configured to releasably couple the shaving head 5 to the main body 3 of the shaving device 1. The coupling member 13 is only schematically shown in FIG. 2 and may comprise a mechanical snap connector for engagement with a co-operating snap connector provided on the main body 3. Such a snap connector is well known to the skilled person. The shaving unit 11 is releasably couplable to the base structure 9 of the shaving head 5. FIG. 1 shows the shaving head 5 in an assembled condition wherein the shaving unit 11 is coupled to the base structure 9. FIG. 2 shows the shaving head 5 in a condition wherein the shaving unit 11 is separated from the base structure 9. The base structure 9 and the shaving unit 11 may be provided with any suitable co-operating coupling elements, not shown in FIG. 2, for releasable coupling of the shaving unit 11 to the base structure 9, for example co-operating mechanical snap connectors which are well known to the skilled person.

As further shown in FIG. 2, the base structure 9 comprises three rotatable drive spindles 15*a*, 15*b*, 15*c*, each for rotatably driving a respective one of the three hair cutting units 7*a*, 7*b*, 7*c* when the shaving unit 11 is coupled to the base structure 9. The drive spindles 15*a*, 15*b*, 15*c* can be driven by the actuator in the main body 3, via a suitable transmission mechanism arranged in the base structure 9 and not visible in FIG. 2, when the shaving head 5 is coupled to the main body 3. The base structure 9 further comprises three hair collecting chambers 17*a*, 17*b*, 17*c* for collecting hairs cut by the hair cutting units 7*a*, 7*b*, 7*c* when the shaving unit 11 is coupled to the base structure 9.

The shaving unit 11 comprises a supporting component 19 and further comprises the three hair cutting units 7*a*, 7*b*, 7*c* which are supported by the supporting component 19 in an assembled condition of the shaving unit 11 as shown in FIG. 2. In alternative embodiments the shaving unit according to the invention may comprise a different number of hair cutting units, for example two hair cutting units or more than three hair cutting units. As shown in FIG. 1 and FIG. 2, the supporting component 19 is a supporting frame provided with three openings wherein the hair cutting units 7*a*, 7*b*, 7*c* are arranged and supported in a manner described in detail in the following. The supporting component 19 also comprises the coupling elements for releasable coupling of the shaving unit 11 to the base structure 9 of the shaving head 5.

Figure 3:
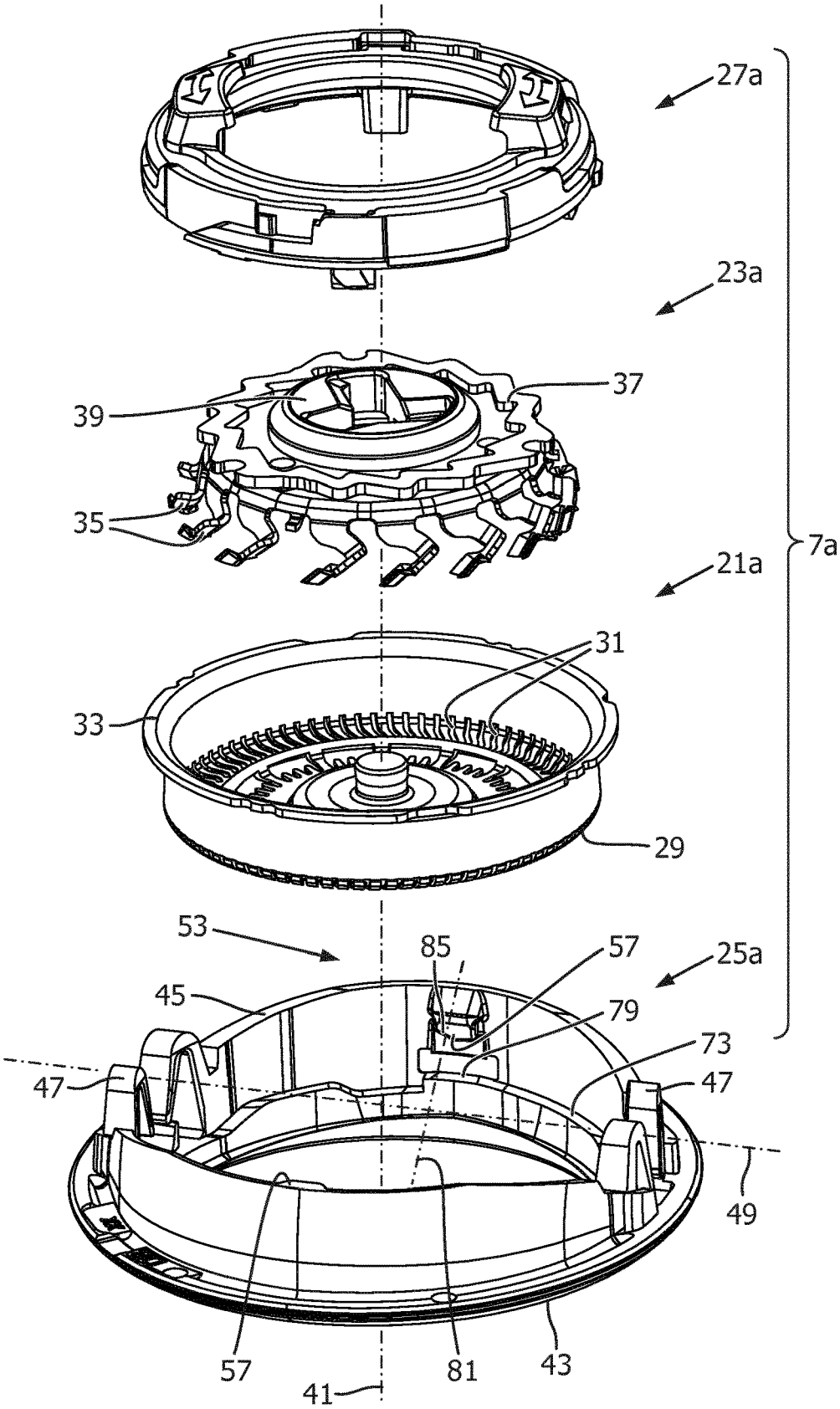
FIG. 3 shows a hair cutting unit according to the invention used in the shaving unit of FIG. 2 with its main parts in a disassembled condition.

FIG. 3 shows one of the three hair cutting units 7*a* of the shaving unit 11, wherein the main parts of the hair cutting unit 7*a*, i.e. an external cutting member 21*a*, an internal cutting member 23*a*, a supporting member 25*a* and a retaining component 27*a* are shown in a mutually disassembled condition. The hair cutting units 7*b* and 7*c* are each similar to the hair cutting unit 7*a* and, accordingly, each comprise an external cutting member 21*b*, 21*c* (FIG. 1), an internal cutting member, a supporting member 25*b*, 25*c* (FIG. 1) and a retaining component 27*b*, 27*c* (FIG. 2) similar to, respectively, the external cutting member 21*a*, the internal cutting member 23*a*, the supporting member 25*a* and the retaining component 27*a*.

The external cutting member 21*a* is generally in the form of a cylindrical cap having an annular external shaving surface 29, visible in FIG. 1 and partially visible in FIG. 3, wherein a plurality of hair-entry openings 31 is provided. The external cutting member 21*a* further comprises a circumferential flange 33 provided at a side of the cap remote from the shaving surface 29.

The internal cutting member 23*a* has a plurality of hair-cutting elements 35 which are provided in an annular configuration on a carrying member 37 of the internal cutting member 23*a*. The carrying member 37 has a central coupling cavity 39 for receiving the associated drive spindle 15*a* in the assembled condition of the shaving head 5. In said assembled condition the internal cutting member 23*a* is rotatable relative to the external cutting member 21*a* about an axis of rotation 41 by means of the drive spindle 15*a*. During rotation of the internal cutting member 23*a* relative to the external cutting member 21*a*, hairs that penetrate through the hair-entry openings 31 of the external cutting member 21*a* are cut by interaction between cutting edges provided on the hair-cutting elements 35 of the internal cutting member 23*a* and counter cutting edges provided on side walls of the hair-entry openings 31 of the external cutting member 21*a*.

The supporting member 25*a* comprises a skin contacting surface 43, visible in FIG. 1 and partially visible in FIG. 3, which surrounds the external cutting member 21*a* in the assembled condition of the shaving unit 11 as shown in FIG. 1. The supporting member 25*a* further comprises a mainly cylindrical receiving member 45 visible in FIG. 3. In the assembled condition of the shaving unit 11, the receiving member 45 accommodates the external cutting member 21*a* together with the internal cutting member 23*a* arranged in the external cutting member 21*a*, wherein the external cutting member 21*a* and the internal cutting member 23*a* are retained in an operational position relative to the supporting member 25*a* by means of the retaining component 27*a* in a manner described in detail in the following.

The supporting member 25*a* is pivotally supported by the supporting component 19 of the shaving unit 11. For this purpose the supporting member 25*a* comprises two pivot members 47 which are arranged on the supporting member 25*a* in two diametrically opposite positions relative to the axis of rotation 41. The two pivot members 47 engage two co-operating pivot members, not visible in the figures, which are provided near the opening in the supporting component 19 wherein the hair cutting unit 7*a* is arranged. By means of the pivot members 47, in the assembled condition of the shaving unit 11 the supporting member 25*a* is pivotal relative to the supporting component 19, together with the external cutting member 21*a* and the internal cutting member 23*a*, about a primary pivot axis 49 defined by the positions of the two co-operating pivot members provided on the supporting component 19. Since the other supporting members 25*b*, 25*c* are similar to the supporting member 25*a*, each supporting member 25*a*, 25*b*, 25*c* is individually pivotal relative to the supporting component 19 independently of any other of the supporting members 25*a*, 25*b*, 25*c*. Thus, when the shaving unit 11 is used on a curved skin surface, the orientations of the hair cutting units 7*a*, 7*b*, 7*c* relative to the supporting component 19 can be individually adapted to local skin contours, so that the hair cutting units 7*a*, 7*b*, 7*c* will remain in optimum contact with the skin.

In an alternative embodiment of the shaving unit according to the invention, not shown in the figures, the supporting members 25*a*, 25*b*, 25*c* are not pivotal relative to the supporting component 19 and are each mounted in a fixed position relative to the supporting component 19 or integrally formed with the supporting component 19. In such an alternative embodiment, the supporting members 25*a*, 25*b*, 25*c* may merely constitute rim portions of the supporting component 19 surrounding the openings in the supporting component 19 wherein the external cutting members 21*a*, 21*b*, 21*c* are arranged, and the external cutting members and the internal cutting members of the hair cutting units 7*a*, 7*b*, 7*c* may be retained in their operational positions relative to said rim portions by means of the retaining components 27*a*, 27*b*, 27*c*.

Figure 4:
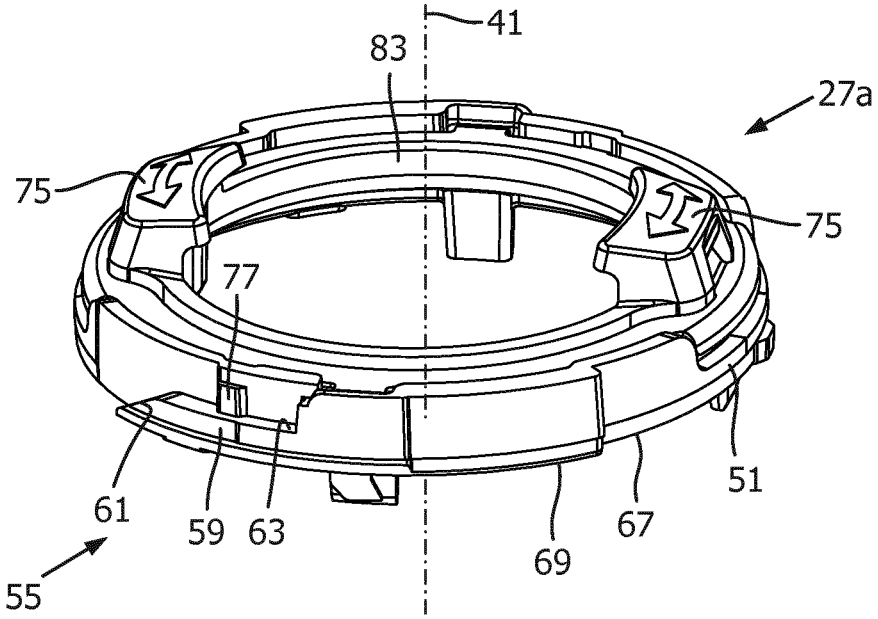
FIG. 4 shows a retaining component of the hair cutting unit of FIG. 3.

The retaining component 27*a* is shown in detail in FIG. 4 and comprises a mainly annular base portion 51. The base portion 51 is releasably couplable to the supporting member 25*a* by means of a coupling structure, which will be described in detail in the following and which comprises a first guiding member 53 (FIG. 3) provided on the supporting member 25*a* and a second guiding member 55 (FIG. 4) provided on the retaining component 27*a*. The base portion 51 is configured to retain the external cutting member 21*a* in its operational position relative to the supporting member 25*a* when, in the assembled condition of the hair cutting unit 7*a*, the retaining component 27*a* is coupled to the supporting member 25*a* by means of the coupling structure.

As shown in FIG. 3, the first guiding member 53 comprises two abutment elements 57 which are provided on an inner wall of the receiving member 45 of the supporting member 25*a* in two diametrically opposite positions relative to the axis of rotation 41. In FIG. 3 only one abutment element 57 is fully visible, the other abutment element is only partially visible. As shown in FIG. 4, the second guiding member 55 comprises two guiding elements 59 which are provided on two circumferential portions of the base portion 51 of the retaining component 27*a* in two diametrically opposite positions relative to the axis of rotation 41. In FIG. 4 only one guiding element 59 is visible. The guiding elements 59 each comprise a first guiding surface 61 which, in the assembled condition of the hair cutting unit 7*a*, extends obliquely relative to a tangential direction relative to the axis of rotation 41, and a second guiding surface 63 which meets the first guiding surface 61 and, in said assembled condition, extends in an imaginary plane perpendicular to the axis of rotation 41. The two abutment elements 57 are arranged to engage the first and second guiding surfaces 61, 63 in a manner as described in detail in the following.

To assemble the hair cutting units 7*a*, 7*b*, 7*c* starting from the disassembled condition shown in FIG. 3, the user may first place the supporting component 19 of the shaving unit 11, with the supporting members 25*a*, 25*b*, 25*c* pivotally mounted to the supporting component 19, in an upside-down position on a flat surface, such as a table top surface, i.e. with the skin contacting surfaces 43 of the supporting members 25*a*, 25*b*, 25*c* being in contact with said flat surface. As will become clear from the following description, the shaving unit 11 may remain in this position during the assembly of the hair cutting units 7*a*, 7*b*, 7*c*, which is convenient for the user. During assembly, the user may thus hold the supporting component 19 with one hand such that the supporting members 25*a*, 25*b*, 25*c* remain in contact with said flat surface, while the user may successively assemble the hair cutting units 7*a*, 7*b*, 7*c* with the other hand, as will be described in detail in the following for the hair cutting unit 7*a*.

Figure 5:
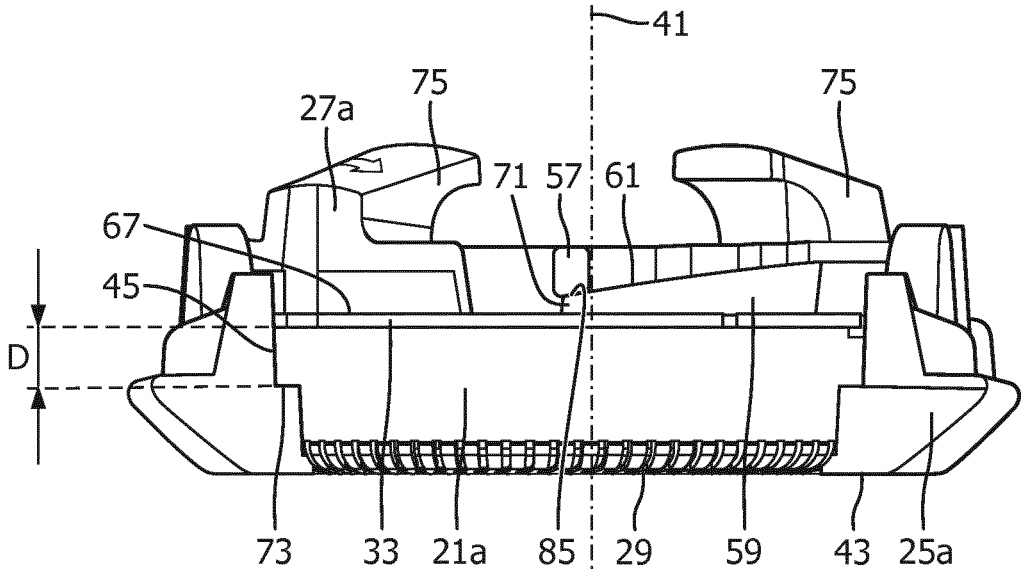
FIG. 5 schematically shows the hair cutting unit of FIG. 3 with the retaining component in a first angular position relative to the supporting member.
Figure 6A:
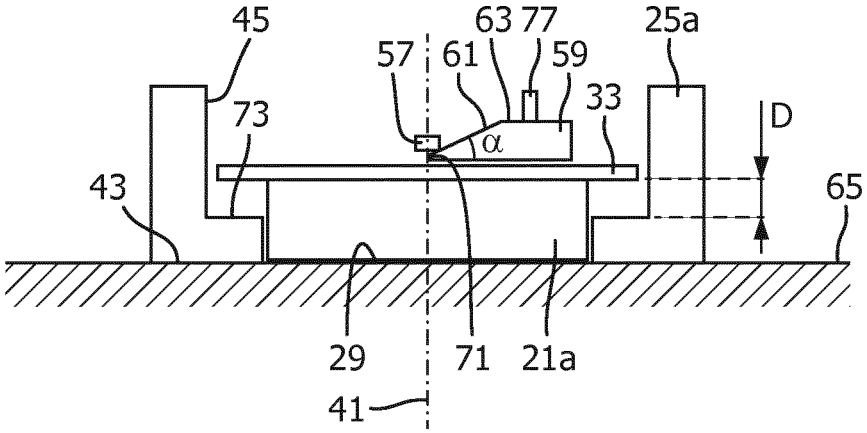
FIG. 6*a*, FIG. 6*b* and FIG. 6*c* schematically show the hair cutting unit as shown in FIG. 5 with the retaining component in, respectively, the first angular position, an intermediate angular position between the first angular position and a second angular position, and the second angular position.
Figure 6B:
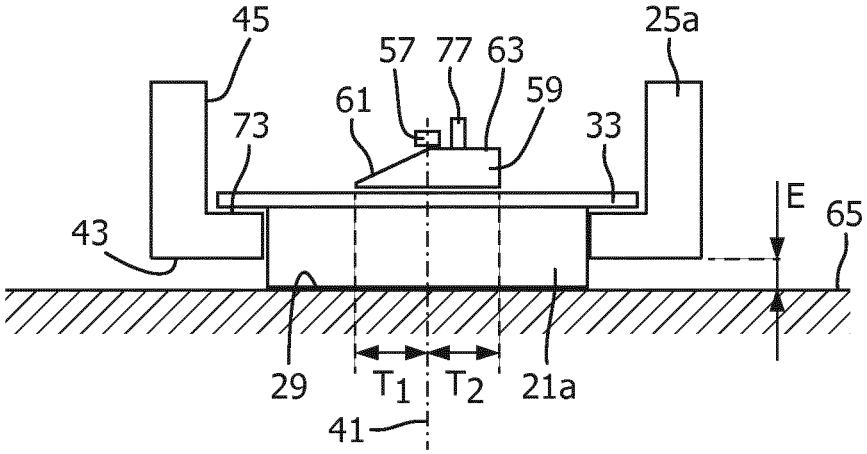
Figure 6C:
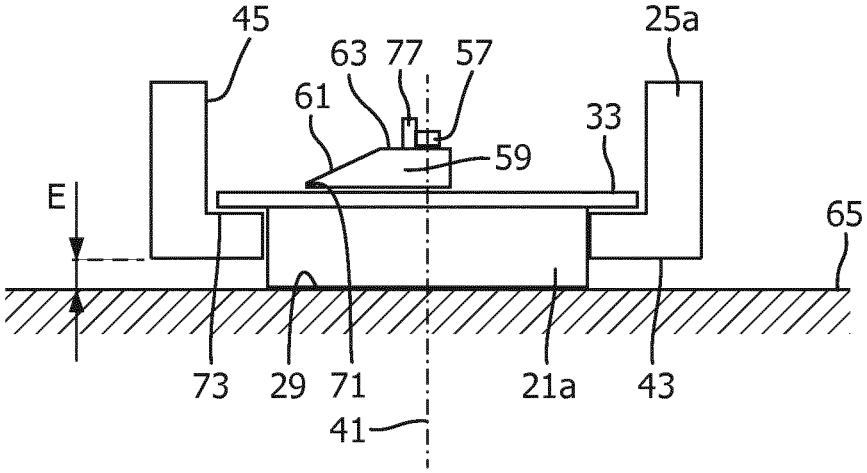

The assembly of the hair cutting unit 7*a* is illustrated in FIG. 5 and in FIGS. 6*a*-6*c*, wherein FIGS. 6*a*-6*c* schematically show a table top surface 65 on which the supporting member 25*a* comprising the skin contacting surface 43 is initially placed in the upside-down position. To assemble the hair cutting unit 7*a*, the user first has to place the internal cutting member 23*a* into the external cutting member 21*a* such that the plurality of hair-cutting elements 35 contact the annular shaving track of the external cutting member 21*a* comprising the hair-entry openings 31. Subsequently the user has to place the external cutting member 21*a*, with the internal cutting member 23*a* arranged therein, in the receiving member 45 of the supporting member 25*a*. Thereby the external cutting member 21*a* will come into an initial fully recessed position relative to the skin contacting surface 43 of the supporting member 25*a*, because the external shaving surface 29 of the external cutting member 21*a* will initially be supported by the table top surface 65 as schematically shown in FIG. 6*a*. Subsequently the user has to place the retaining component 27*a* in the receiving member 45 on top of the external cutting member 21*a*. Thereby, a side 67 of the annular base portion 51 of the retaining component 27*a*, which faces the external cutting member 21*a* in the assembled condition of the hair cutting unit 7*a*, will abut against the circumferential flange 33 of the external cutting member 21*a*. This side 67 may be fully in contact with the flange 33, i.e. over 360° about the axis of rotation 41. In the present embodiment, however, three protruding abutment surfaces 69 are provided on said side 67, which are arranged at 120° angular intervals relative to the axis of rotation 41 and each abut against the flange 33. In FIG. 4 only one abutment surface 69 is visible.

After placing the retaining component 27*a* in the receiving member 45 as described here before, the external cutting member 21*a*, the supporting member 25*a* and the retaining component 27*a* will be in mutual positions in an axial direction relative to the axis of rotation 41 as shown in FIG. 5. The internal cutting member 23*a* is not shown in FIG. 5. FIG. 5 schematically shows one of the abutment elements 57 of the first guiding member 53 of the supporting member 25*a*. FIG. 5 further schematically shows one of the guiding elements 59 of the second guiding member 55 of the retaining component 27*a*. In FIG. 5 the retaining component 27*a* is shown in a first predefined angular position about the axis of rotation 41 relative to the supporting member 25*a*. In this first angular position of the retaining component 27*a*, the abutment element 57 engages an end portion 71 of the first oblique guiding surface 61 of the guiding element 59 when the external cutting member 21*a* is in its initial fully recessed position relative to the skin contacting surface 43 of the supporting member 25*a*. This first angular position of the retaining component 27*a* is also schematically shown in FIG. 6*a*, which does not show any parts of the retaining component 27*a* other than the guiding element 59. As further shown in FIG. 5 and FIG. 6*a*, a distance D is present between the circumferential flange 33 of the external cutting member 21*a* and an annular internal rim 73 provided on the inner wall of the receiving member 45 of the supporting member 25*a*. It is clear for the skilled person that said distance D causes the flange 33 to be movable parallel to the axis of rotation 41 between the abutment surfaces 69 of the retaining component 27*a* and said internal rim 73 of the receiving member 45 over said distance D when the shaving unit 11 would not be held in contact with the table top surface 65.

To couple the retaining component 27*a* to the supporting member 25*a* and thereby finally realize the assembled condition of the hair cutting unit 7*a*, the user has to manually turn the retaining component 27*a* relative to the supporting member 25*a* about the axis of rotation 41 from the first predefined angular position schematically shown in FIG. 6*a* to a second predefined angular position schematically shown in FIG. 6*c* via an intermediate angular position between the first and second angular positions as shown in FIG. 6*b*. For this purpose the base portion 51 of the retaining component 27*a* comprises two finger-grip portions 75 (FIG. 4, FIG. 5) which are arranged in two diametrically opposite positions relative to the axis of rotation 41. During rotation of the retaining component 27*a* from the first angular position to the second angular position, while the supporting member 25*a* is held in contact with the table top surface 65, the two abutment elements 57 of the first guiding member 53 engage the two guiding elements 59 of the second guiding member 55 in any angular position of the retaining component 27*a* about the axis of rotation 41 relative to the supporting member 25*a* between the first and second angular positions. By the engagement of the abutment elements 57 and the first oblique guiding surfaces 61 of the guiding elements 59 during rotation of the retaining component 27*a* from the first angular position shown in FIG. 6*a* to the intermediate angular position shown in FIG. 6*b*, the retaining component 27*a* is displaced relative to the supporting member 25*a* in the axial direction parallel to the axis of rotation 41 towards the skin contacting surface 43 of the supporting member 25*a* until the retaining component 27*a* reaches an axial retaining position as shown in FIG. 6*b* wherein the circumferential flange 33 of the external cutting member 21*a* abuts the internal rim 73 of the supporting member 25*a*. To lock the retaining component 27*a* in said axial retaining position, the user has to further turn the retaining component 27*a* from the intermediate angular position shown in FIG. 6*b* into the second angular position shown in FIG. 6*c*. During this further turn, the abutment elements 57 engage the second guiding surfaces 63 of the guiding elements 59 to establish the assembled condition of the hair cutting unit 7*a*. During said further turn, the abutment elements 57 each pass an elastically deformable locking element 77 integrally formed on the base portion 51 of the retaining component 27*a* and arranged adjacent to the respective second guiding surface 63. Only one locking element 77 is visible in FIG. 4, while the locking element 77 is schematically shown in FIGS. 6*a*-6*c*. The locking elements 77 prevent the retaining component 27*a* from rotating out of the second angular position when no rotational force is exerted thereon.

In the axial retaining position of the retaining component 27*a* and the assembled condition of the hair cutting unit 7*a* schematically shown in FIG. 6*c*, the circumferential flange 33 of the external cutting member 21*a* is retained in the axial direction parallel to the axis of rotation 41 between the three abutment surfaces 69 of the retaining component 27*a* and the internal rim 73 of the supporting member 25*a*. In this assembled condition, the circumferential flange 33 thus constitutes a retained element of the external cutting member 21*a*, the three abutment surfaces 69 thus constitute a first retaining member for said retained element provided on the retaining component 27*a*, and the internal rim 73 thus constitutes a second retaining member for the retained element provided on the supporting member 25*a*. In the embodiment of the supporting member 25*a* shown in FIG. 3, the internal rim 73 comprises two supporting elements 79 which are each provided on the inner wall of the receiving member 45 in the form of a slightly protruding portion of the internal rim 73. In FIG. 3 only one of the two supporting elements 79 is visible. The other supporting element is in a diametrically opposite position relative to the axis of rotation 41. The supporting elements 79 are each positioned adjacent to a respective one of the two abutment elements 57 seen in the axial direction. Thus, in the assembled condition of the hair cutting unit 7*a*, the circumferential flange 33 of the external cutting member 21*a* is in particular supported by the two supporting elements 79 of the second retaining member. The slightly protruding positions of the two supporting elements 79 relative to the internal rim 73 allow the external cutting member 21*a* to pivot relative to the supporting member 25*a*, together with the retaining component 27*a*, about a secondary pivot axis 81 defined by the positions of the two supporting elements 79.

Furthermore, in the axial retaining position of the retaining component 27*a* and the assembled condition of the hair cutting unit 7*a*, the internal cutting member 23*a* is held in position in the external cutting member 21*a* with some play in the direction parallel to the axis of rotation 41 by means of an internal annular flange 83 provided on the base portion 51 of the retaining member 27*a* as shown in FIG. 4. When subsequently the shaving unit 11 is coupled to the base structure 9 of the shaving head 5, the hair-cutting elements 35 of the internal cutting member 23*a* will be urged into operational contact with the annular shaving track of the external cutting member 21*a* by the drive spindle 15*a*.

During the rotation of the retaining component 27*a* from the first angular position shown in FIG. 6*a* to the intermediate angular position shown in FIG. 6*b* and the associated displacement of the retaining component 27*a* relative to the supporting member 25*a* in the axial direction into its axial retaining position as described in detail here before, the external cutting member 21*a* is displaced by the retaining component 27*a* in the axial direction from its initial fully recessed position as shown in FIG. 6*a* into its operational position as shown in FIG. 6*b* and FIG. 6*c*, wherein the shaving surface 29 of the external cutting member 21*a* protrudes relative to the skin contacting surface 43 of the supporting member 25*a* in the axial direction over an exposure distance E as indicated in FIG. 6*b* and FIG. 6*c*. FIG. 6*b* and FIG. 6*c* show the shaving surface 29 in a parallel orientation relative to the skin contacting surface 43. It will be clear that, in an orientation of the shaving surface 29 wherein the external cutting member 21*a* is pivoted relative to the supporting member 25*a* about the secondary pivot axis 81, the exposure distance E will be an average exposure distance of the shaving surface 29 relative to the skin contact surface 43. It will be clear that, to enable the initial fully recessed position of the external cutting member 21*a* relative to the skin contacting surface 43 of the supporting member 25*a* in the first angular position of the retaining component 27*a* as shown in FIG. 6*a*, the distance D in FIG. 6*a* over which the retained element (i.e. the circumferential flange 33) of the external cutting member 21*a* should be moveable in the axial direction between the first retaining member (i.e. the abutment surfaces 69) and the second retaining member (i.e. the supporting elements 79) in the first angular position of the retaining component 27*a* as described here before should be at least equal to the exposure distance E.

As schematically shown in FIG. 6*a*, in the embodiment shown in the figures the first guiding surfaces 61 of the guiding elements 59 of the second guiding member 55 have an inclination angle $\alpha$ relative to the tangential direction relative to the axis of rotation 41, and the first guiding surfaces 61 are plain seen in a tangential cross-section relative to the axis of rotation 41. As further schematically shown in FIG. 6*b*, the first guiding surfaces 61 and the second guiding surfaces 63 extend over equal distances $T_1$, $T_2$ in the tangential direction, which implies that the first guiding surfaces 61 extend over an angular distance about the axis of rotation 41 which is about 50% of an angular distance between the first and second predefined angular positions of the retaining component 27*a*. It will be clear for the skilled person that the above mentioned distance D is mainly determined by said inclination angle α and said distance $T_1$. It will also be clear for the skilled person that the first guiding surfaces 61 need not to be plain, seen in said tangential cross-section. The first guiding surfaces 61 may be curved in this cross-section. To limit a torque, which the user needs to exert on the retaining component 27*a* about the axis of rotation 41 in order to rotate the retaining component 27*a* from the first angular position to the second angular position and establish the assembled condition of the hair cutting unit 7*a*, it is to be preferred that the first guiding surfaces 61 extend over an angular distance about the axis of rotation 41 which is at least 15% of said angular distance between the first and second predefined angular positions of the retaining component 27*a*. In the embodiment of the retaining component 27*a* shown in FIG. 4, the first guiding surfaces 61 extend over an angular distance about the axis of rotation 41 which is between 15% and 50% of said angular distance between the first and second predefined angular positions.

As further shown in FIG. 3, the abutment elements 57 may each comprise an additional guiding surface 85 which, in the assembled condition, extends obliquely relative to the tangential direction for co-operation with the first guiding surfaces 61 of the second guiding member 55. For this purpose, the additional guiding surfaces 85 may have a similar inclination angle α relative to the tangential direction as the first guiding surfaces 61. The additional guiding surfaces 85 facilitate the initial engagement of the abutment elements 57 and the first guiding surfaces 61 in the first angular position of the retaining component 27*a* relative to the supporting member 25*a*. The additional guiding surface 85 is also schematically shown in FIG. 5, but is not shown in the FIGS. 6*a*-6*c*.

It will further be clear for the skilled person that, to establish the distance D in the first predefined angular position of the retaining component 27*a* as described here before and to establish the assembled condition of the hair cutting unit 7*a* in the second predefined angular position of the retaining component 27*a* as described here before, the first and second guiding members of the coupling structure for coupling the retaining component 27*a* to the supporting member 25*a* may be configured different form the first and second guiding members 53, 55 as described here before. For example, the guiding elements 59 comprising the inclined first guiding surfaces 61 may be arranged on the inner wall of the receiving member 45 of the supporting member 25*a*, and the abutment elements 57 may be arranged on the circumferential wall of the base portion 51 of the retaining component 27*a*. In this example, the abutment elements 57 on the retaining component 27*a* may be provided with additional guiding surfaces similar to the additional guiding surfaces 85 for co-operation with the inclined first guiding surfaces on the supporting member 25*a*.

Finally, it will be clear for the skilled person that the retained element of the external cutting member 21*a* may be embodied differently from the circumferential flange 33 and may be embodied in any suitable way in order to be retainable between the first retaining member of the retaining component 27*a* and the second retaining member of the supporting member 25*a*. Likewise, it will be clear that the first retaining member and the second retaining member may be embodied differently from, respectively, the abutment surfaces 69 and the supporting elements 79 and may be embodied in any suitable way in order to retain the retained element of the external cutting member 21*a* in the assembled condition of the hair cutting unit 7*a*.

While the invention has been described and illustrated in detail in the foregoing description and in the drawings, such description and illustration are to be considered as exemplary and/or illustrative and not in a limiting sense. The invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. For the purpose of clarity and conciseness of the description, features are disclosed herein as part of the same embodiment or as part of separate embodiments, however, it will be appreciated that the scope of the invention may include embodiments having combinations of all or some of the features disclosed. The mere fact that certain measures are recited in mutually different dependent claims does not indicate that a combination of these measures cannot be used to advantage.

The invention claimed is:

1. A hair cutting unit for use in a shaving device, said hair cutting unit comprising:

an external cutting member having a shaving surface with hair-entry openings;

an internal cutting member which is rotatable relative to the external cutting member about an axis of rotation and which has a plurality of hair-cutting elements;

a supporting member having a skin contacting surface surrounding the external cutting member; and a retaining component which is releasably couplable to the supporting member by a coupling structure and which is configured to retain the external cutting member in an operational position relative to the supporting member in an assembled condition of the hair cutting unit;

wherein in the assembled condition:

a retained element of the external cutting member is retained between a first retaining member of the retaining component and a second retaining member of the supporting member at least in an axial direction parallel to the axis of rotation;

in a parallel orientation of the shaving surface relative to the skin contacting surface, the shaving surface protrudes relative to the skin contacting surface in the axial direction over an exposure distance; and wherein the coupling structure comprises a first guiding member provided on the supporting member and a second guiding member provided on the retaining component, the first and second guiding members being configured to:

mutually engage when the retaining component is in any angular position between a first angular position and a second angular position about the axis of rotation relative to the supporting member, the first and second angular positions being mutually different; and establish the assembled condition in the second angular position of the retaining component, and wherein the first and second guiding members are configured such that, when the first and second guiding members mutually engage in the first angular position of the retaining component, the retained element of the external cutting member is moveable between the first and second retaining members parallel to the axis of rotation over a distance which is at least equal to the exposure distance such that the shaving surface of the external cutting member protrudes from a minimum position to a maximum position in the axial direction away from the skin contacting surface of the supporting member by a distance up to the exposure distance in response to manually turning the retaining component relative to the supporting member about the axis of rotation by an angular distance from the first angular position to the second angular position, and wherein:

the retaining component has an annular base portion;

the supporting member has a cylindrical receiving member for accommodating the external cutting member;

the second guiding member comprises two guiding elements provided on two diametrically opposite circumferential portions of the annular base portion and each comprising a guiding surface which, in the assembled condition, extends obliquely relative to a tangential direction relative to the axis of rotation; and the first guiding member comprises two abutment elements provided in diametrically opposite positions on an inner wall of the receiving member for engaging the guiding surface of a respective one of the two guiding elements.

2. The hair cutting unit as claimed in claim 1, wherein the second guiding member comprises a guiding surface which, in the assembled condition, extends obliquely relative to the tangential direction relative to the axis of rotation, and wherein the first guiding member comprises an abutment element for engaging the guiding surface.

3. The hair cutting unit as claimed in claim 2, wherein the abutment element comprises an additional guiding surface which, in the assembled condition, extends obliquely relative to the tangential direction for co-operation with the guiding surface of the second guiding member.

4. The hair cutting unit as claimed in claim 2, wherein the guiding surface extends obliquely over the angular distance about the axis of rotation which is at least equal to 15% of an angular distance between the first and second angular positions.

5. The hair cutting unit as claimed in claim 2, wherein the guiding surface is one of planar and curved seen in a tangential cross-section relative to the axis of rotation.

6. The hair cutting unit as claimed in claim 1, wherein the retained element is a circumferential flange of the external cutting member.

7. The hair cutting unit as claimed in claim 1, wherein:

the first retaining member comprises a plurality of abutment surfaces provided on a side of the annular base portion facing the retained element of the external cutting member in the assembled condition; and the second retaining member comprises two supporting elements provided in diametrically opposite positions on the inner wall of the receiving member, each supporting element being positioned adjacent to a respective one of the two abutment elements of the first guiding member seen in the axial direction.

8. A shaving unit comprising at least two hair cutting units and a supporting component supporting the at least two hair cutting units, wherein each hair cutting unit is a hair cutting unit according to claim 1.

9. The shaving unit as claimed in claim 8, wherein the supporting member of each hair cutting unit is pivotally supported by the supporting component.

10. A shaving head comprising:

a base structure including a coupling member configured to releasably couple the shaving head to a main body of a shaving device; and a shaving unit which is releasably couplable to the base structure;

wherein the shaving unit is a shaving unit according to claim 8.

11. A shaving device comprising:

a main body accommodating an actuator; and a shaving head which is releasably couplable to the main body for being driven by the actuator;

wherein the shaving head is a shaving head according to claim 10.

12. The hair cutting unit as claimed in claim 1, wherein the angular distance about the axis of rotation present between the first and second angular positions is smaller than 360.

13. A hair cutting unit comprising:

an external cutter having a shaving surface with hair-entry openings;

an internal cutter which is rotatable relative to the external cutting member about an axis of rotation;

a support having a skin contacting surface surrounding the external cutter; and a retainer releasably couplable to the support and configured to retain the external cutter and the internal cutter in the support, wherein the shaving surface of the external cutter protrudes from a minimum position to a maximum position in an axial direction parallel to the axis of rotation away from the skin contacting surface of the support in response to rotation of the retainer relative to the support about the axis of rotation, and wherein:

the retaining component has an annular base portion;

the supporting member has a cylindrical receiving member for accommodating the external cutting member;

the second guiding member comprises two guiding elements provided on two diametrically opposite circumferential portions of the annular base portion and each comprising a guiding surface which, in the assembled condition, extends obliquely relative to a tangential direction relative to the axis of rotation; and the first guiding member comprises two abutment elements provided in diametrically opposite positions on an inner wall of the receiving member for engaging the guiding surface of a respective one of the two guiding elements.

14. The hair cutting unit of claim 13, wherein in an assembled condition, a retained element of the external cutter is retained between a protruding abutment surface of the retainer and an annular internal rim of the supporting member at least in an axial direction parallel to the axis of rotation.

15. The hair cutting unit of claim 13, wherein the support includes a first guide, and the retainer includes a second guide, and wherein the first and second guides are configured to:

mutually engage when the retainer is in any angular position between a first angular position and a second angular position about the axis of rotation relative to the support, the first and second angular positions being mutually different; and establish an assembled condition in the second angular position of the retainer where the shaving surface of the external cutter protrudes in the axial direction away from the skin contacting surface of the support.

16. A shaver comprising:

a main body accommodating an actuator; and a shaving head releasably couplable to the main body for being driven by the actuator, the shaving head including a base and at least two shaving assemblies releasably couplable to the base, wherein each shaving assembly of the at least two shaving assemblies includes:

an external cutter having a shaving surface with hair-entry openings;

an internal cutter which is rotatable relative to the external cutting member about an axis of rotation;

a support having a skin contacting surface surrounding the external cutter; and a retainer releasably couplable to the support and configured to retain the external cutter and the internal cutter in the support, wherein the shaving surface of the external cutter protrudes from a minimum position to a maximum position in an axial direction parallel to the axis of rotation away from the skin contacting surface of the support in response to rotation of the retainer relative to the support about the axis of rotation, and wherein:

the retaining component has an annular base portion;

the supporting member has a cylindrical receiving member for accommodating the external cutting member;

the second guiding member comprises two guiding elements provided on two diametrically opposite circumferential portions of the annular base portion and each comprising a guiding surface which, in the assembled condition, extends obliquely relative to a tangential direction relative to the axis of rotation; and the first guiding member comprises two abutment elements provided in diametrically opposite positions on an inner wall of the receiving member for engaging the guiding surface of a respective one of the two guiding elements.

17. The shaver of claim 16, wherein in an assembled condition, a retained element of the external cutter is retained between a protruding abutment surface of the retainer and an annular internal rim of the supporting member at least in an axial direction parallel to the axis of rotation.

18. The shaver of claim 16, wherein the support includes a first guide, and the retainer includes a second guide, and wherein the first and second guides are configured to mutually engage when the retainer is in any angular position between a first angular position and a second angular position about the axis of rotation relative to the support, the first and second angular positions being mutually different; and establish an assembled condition in the second angular position of the retainer where the shaving surface of the external cutter protrudes in the axial direction away from the skin contacting surface of the support.

19. The shaver of claim 16, wherein the support of the each shaving assembly is pivotally supported by a supporting component.

* * * * *